US005089848A

United States Patent [19]

Kusuda et al.

[11] Patent Number: 5,089,848

[45] Date of Patent: Feb. 18, 1992

[54] ABNORMAL CHARGE AND TONER DENSITY DETECTING SYSTEM AND METHOD FOR USE IN AN ELECTROSTATIC COPIER

[75] Inventors: Yasuhiro Kusuda; Masahide Ueda; Takashi Onishi; Tadafumi Shimizu, all of Osaka, Japan

[73] Assignee: Minolta Camera Kabushiki Kaisha, Osaka, Japan

[21] Appl. No.: 500,937

[22] Filed: Mar. 29, 1990

[30] Foreign Application Priority Data

Mar. 31, 1989 [JP] Japan ..... 1-82441

[51] Int. Cl.[5] ..... G03G 21/00

[52] U.S. Cl. ..... 355/206; 355/208; 355/246

[58] Field of Search ..... 355/206, 208, 214, 246, 355/215

[56] References Cited

U.S. PATENT DOCUMENTS 4,215,930 8/1980 Miyakawa et al. ..... 355/208
4,709,250 11/1987 Takeuchi ..... 355/214 X
4,910,557 3/1990 Imai ..... 355/208 X
5,012,279 4/1991 Nakajima et al. ..... 355/246 X

FOREIGN PATENT DOCUMENTS 62-81679 4/1987 Japan .
62-177571 8/1987 Japan .
63-309978 12/1988 Japan .

*Primary Examiner*—Fred L. Braun
*Attorney, Agent, or Firm*—Burns, Doane, Swecker & Mathis

[57] ABSTRACT

An image forming apparatus which detects the cause of the image unevenness in the image formation of an electrostatic recording system used for a copying machine, laser beam printer or the like, and automatically takes measures responding thereto. This image forming apparatus includes a surface potential sensor for detecting charge unevenness after charging a photoconductive drum by a charger and a toner density sensor for detecting toner adhesion unevenness after developing by a developing unit, and based on the results of detections of these sensors, when charge unevenness exits, the apparatus judges that the cause of the image unevenness is an abnormal state of the charger, and cleans a charge wire, and when no charge unevenness exists and density unevenness exists, the apparatus judges that the developing unit is abnormal, and displays this abnormality and inhibits the operation of the apparatus. The apparatus further includes a toner sensor for detecting density unevenness after transfer, and when density unevenness is detected by this sensor, it is judged that the cause of the image unevenness is an abnormal state of a transferring charger, and displays this abnormality and inhibits the operation of the apparatus.

23 Claims, 13 Drawing Sheets

ABNORMAL CHARGE AND TONER DENSITY DETECTING SYSTEM AND METHOD FOR USE IN AN ELECTROSTATIC COPIER

BACKGROUND OF THE INVENTION

1. Field of the Invention

The present invention relates to an image forming apparatus of electrostatic recording system such as a copying machine and a laser beam printer and a method of forming an image for detecting an abnormal state thereof, and particularly relates to an image forming apparatus detecting a cause of image defect and a method of forming an image for detecting a cause of abnormality.

2. Description of Related Art

In the image forming apparatus of electrostatic recording system such as a copying machine, when a charge wire of an electrification charger charging a photoconductive drum is contaminated by toner or the like, a reduction in the charging ability or a charge unevenness takes place, resulting in a reduction in the image density or an image unevenness. Then, in the Japanese Patent Application Laid-Open No. 62-177571, an apparatus has been proposed which is provided with a sensor detecting the surface potential of the photoconductive drum, and cleans the charge wire when the charge unevenness is detected.

However, in the image forming apparatus of electrostatic recording system, unevenness of the formed image is caused not only by a trouble in the surroundings of the electrification charger as described above, but also, for example, by a trouble such as an abnormal state of a developing unit. When the image unevenness is produced, even if it is caused by a simple trouble, the user cannot find the cause of this trouble. Accordingly, the user cannot find the place to be checked, and cannot restore the apparatus to normal state unless he calls a serviceman. Also, for the serviceman, he needs much labor and time to find this cause.

SUMMARY OF THE INVETNION

The present invention has been achieved in view of such circumstances, and a principal object of the present invention is to provide an image forming apparatus capable of clarifying the cause of unevenness of the image density by the apparatus itself.

Another object of the present invention is to provide an image forming apparatus which automatically detects the cause of unevenness of the image density by the apparatus itself, and can automatically correct the unevenness of the image density within a possible range.

To attain these objects, an image forming apparatus in accordance with the present invention provides means for detecting the charge potential of the charged photoconductive drum, and a means for detecting the toner density (amount of adhesion of toner) of the photoconductive drum and/or the transfer member (paper), and when an image unevenness is produced, identifies the equipment causing this unevenness based on the detected results, and when the cause is an abnormal state of charging means, cleans this means to correct the unevenness of the image, and when developing means and/or transferring means are abnormal, displays this abnormality and inhibits the operation of the apparatus.

The above and further objects and features of the invention will more fully be apparent from the following detailed description will accompanying drawings.

DESCRIPTION OF THE PREFERRED EMBODIMENTS

Figure 1:
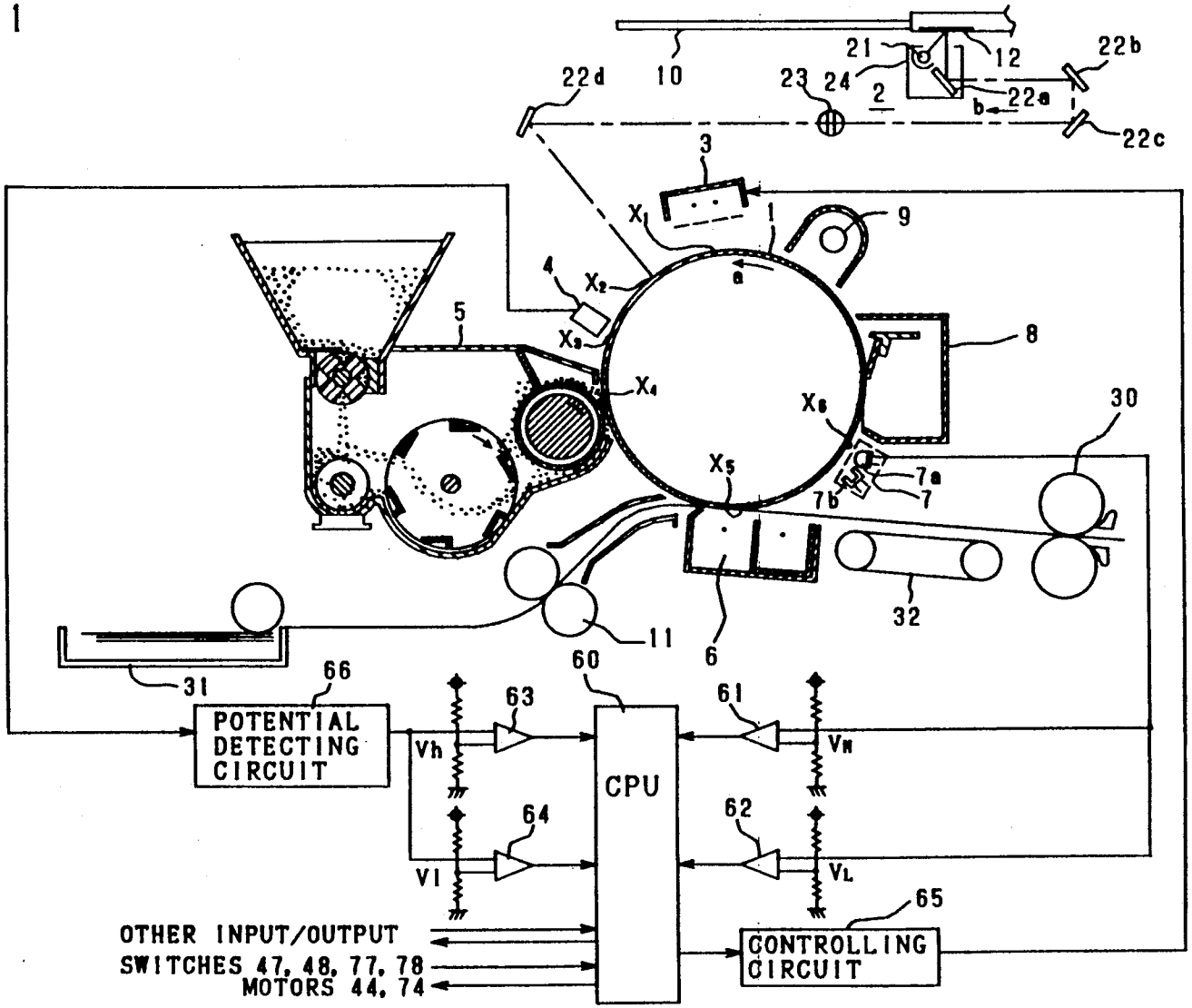
FIG. 1 is a cross-sectional view showing a schematic configuration of a copying machine whereto an image forming apparatus in accordance with the present invention is applied and a block diagram of a control system.

Hereinafter, specific description is made on the present invention based on drawings showing embodiments thereof. First, a schematic configuration that an image forming apparatus in accordance with the present invention is applied to a copying machine is decribed along with schematic operation based on a cross-sectional view and a block diagram of a control system as shown in FIG. 1. Copying operation of this machine is such that, first, in the state that a photoconductive drum 1 is rotated in the direction as shown by an arrow a, a constant quantiy of charges are given to the surface of the photoconductive drum 1 by discharge of an electrification charger 3. Subsequently, a scanner 24 having an exposure lamp 21 of an optical system 2 irradiates light onto a document placed on a document glass plate 10 while making scanning operation in the direction as shown by an arrow b. Reflected light from the document is exposed onto the surface of the photoconductive drum 1 at an exposure point $X_2$ through mirrors *22a–22d* and a lens 23, and an electrostatic latent image corresponding to a document imge is formed. A rectangular reference pattern 12 having a predetermined density (halftone) is installed on the home position side of the document glass plate 10.

The formed electrostatic latent image is supplied with toner in a developing region $X_4$ which is a part opposite to a following developing unit 5, and is made into a real image, and thus a toner image reproducing the document image is formed.

On the other hand, copy paper is stored in a paper feed cassette 31, and is carried to a pair of rollers 11 at a predetermined timing. The carried copy paper is carried to a part opposite to a transfer charger 6 (transferring region $X_5$) by a pair of rollers 11 at a timing taken with the toner image on the photoconductive drum 1. Here, the above-mentioned toner image is transferred onto the copy paper, and thereafter the copy paper is carried to a fixing unit 30 by a carrying conveyer 32, and the toner image is fuse-fixed on the copy paper.

After transferring the toner image, the residual toner on the surface of the photoconductive drum 1 is scraped by a cleaning unit 8, and further the residual charges are erased by light irradiation of an eraser lamp 9, and the next development is prepared.

Figure 2:
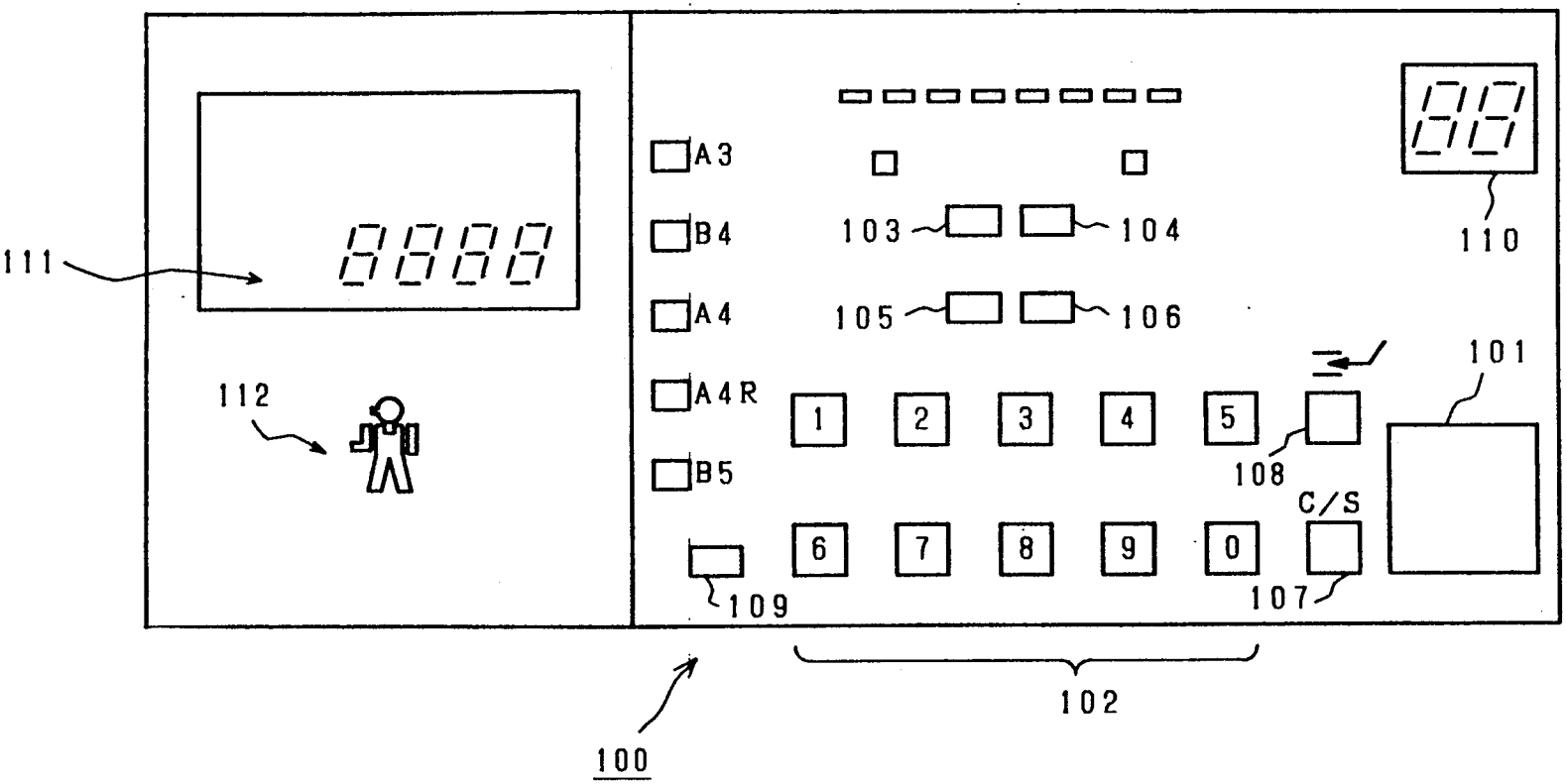
FIG. 2 is a plan view showing a configuration of an operation panel.

FIG. 2 is a plan view of an operation panel of the above-mentioned copying machine.

As shown in FIG. 2, on an operation panel 100, various keys and displaying parts are disposed such as a group of ten-keys 102 entering quantity of copy and the like, a print key 101 commanding start of print, an interrupt key 108 commanding interrupt copy, a clear/stop key 107, a paper select key 109 selecting copy paper size, density up/down keys 103 and 104 setting copy density, copy magnification set keys 105 and 106, a display part 110 segment-displaying quantity of multicopy, an abnormality displaying part 111 segment-displaying an abnormal portion of the copying machine, and a serviceman call displaying part 112 showing necessity of work of restoring from the abnormal state by the serviceman.

The abnormality displaying part 111 makes seven-segment display of four digits, and normally displays copy magnification, and when an abnormal state occurs, displays the abnormal portion by a two-digit code. For example, C1 indicates the electrification charger 3, C2 indicates the developing unit 5, C3 indicates the transfer charger 6 and C4 indicates the fixing unit 30, and further combinations thereof are displayed.

In addition, when the serviceman call displaying part 112 is lit, copying operation is inhibited automatically.

Then, description is made on a mechanism of detecting an image unevenness which is a main point of the present invention. First, two sensors, that is, a surface potential sensor 4 and an image density sensor 7 are installed in the surroundings of the photoconductive drum 1. The surface potential sensor 4 is installed in a region $X_3$ between the exposure point $X_2$ of the above-mentioned photoconductive drum 1 and the developing region $X_4$ of the developing unit 5, and the image density sensor 7 is installed in a region $X_6$ between the transferring region $X_5$ of the transfer charger 6 and the cleaning unit 8 in a manner of facing each other.

The surface potential sensor 4 is publicly known, for example, by the Japanese Patent Application Laid-Open No. 63-309978, and therefore description thereon is omitted.

Also, the image density sensor 7 employs a reflecting-type photo-sensor having a light emitting part 7*a* and a photo-detector part 7*b*. The quantity of light emitted from the light emitting part 7*a* and then reflected from the surface of the photoconductive drum 1 is detected by the photo-detector part 7*b*, and thereby the image density sensor 7 detects the amount of adhesion of toner, that is, the image density in an analog fashion as the quantity of reflected light, and converts the quantity of received light into voltage, and outputs it.

Figure 3:
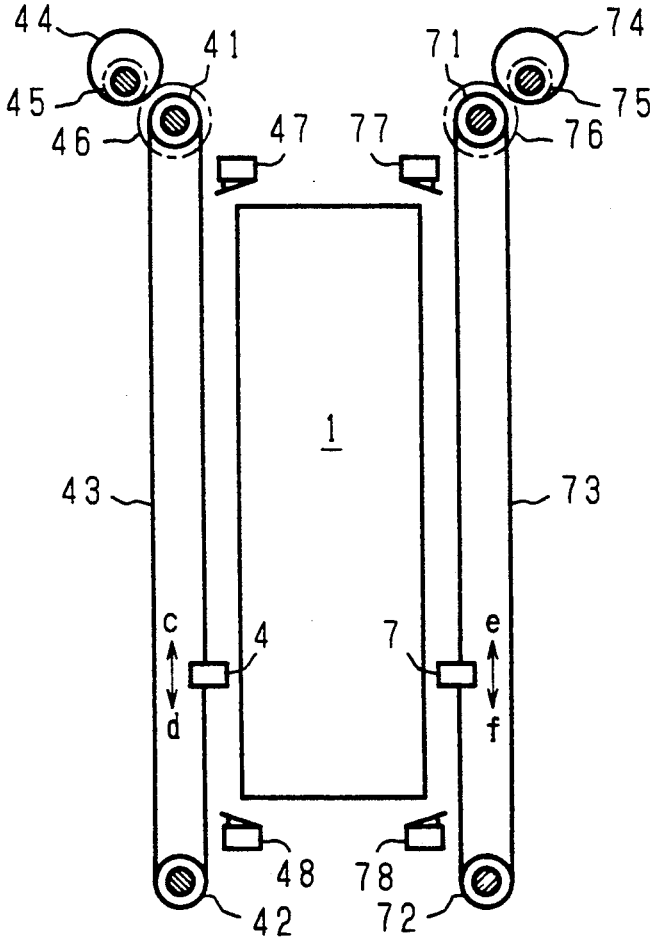
FIG. 3 is a configuration view of a surface potential sensor and an image density sensor.

As shown in a configuration view in FIG. 3, the surface potential sensor 4 (or the image density sensor 7) is attached to a wire 43 (or 73) set betwen a drive pulley 41 and a driven pulley 42 (or a drive pulley 71 and a driven pulley 72). The driving force of a motor 44 (or 74) is transmitted to the drive pulley 41 (or 71) through gears 45 and 46 (or 75 and 76), and thereby the surface potential sensor 4 (or the image density sensor 7) detects the surface potential (or image density) while moving across the total length in the direction of axial length of the detecting region $X_3$ (or $X_6$) of the photoconductive drum 1.

In the vicinity of the both end parts of the photoconductive drum 1 in the moving area of each sensor (4 and 7), switches 47 and 48 (or 77 and 78) are installed respectively, and, for example, when the surface potential sensor 4 (or the image density sensor 7) is moving at present in the direction as shown by an arrow c (or e), that each sensor has reached the end of the detection region is detected by turn-on of the switch 47 (or 77) by each sensor, and driving of the motor 44 (or 74) is stopped. Then, at driving in the next detection, the motor 44 (or 74) is rotated in reverse, and the sensor 4 (or 7) moves in the direction as shown by an arrow d (or f), and similarly when the switch 48 (or 78) is turned on, the motor is stopped.

The detected voltage of the surface potential sensor 4 is given to comparators 63 and 64 through a surface potential detecting circuit 66. The detected voltage is compared with a reference voltage Vh by the comparator 63, and is compared with a reference voltage Vl by the comparator 64 respectively, and when the detected voltage is larger than Vh, or smaller than Vl, that is, when it exceeds the upper limit of a suitable surface potential, of is less than the lower limit, a signal is outputted to a CPU 60.

Similarly, the detected voltage of the image density sensor 7 is given to the comparators 61 and 62. When the detected voltage exceeds or is less than the reference voltages Vh or VL which are determined respectively for the upper limit and the lower limit of a suitable density of image in the toner image of halftone as described later, a signal is outputted to the CPU 60.

To the input terminal of the CPU 60, the above-mentioned switches 47, 48, 77 and 78 are connected, and to the output terminal thereof, the above-mentioned motors 44 and 74 are connected through a driving circuit (not illustrated).

Also, to the output terminal of the CPU 60, a controlling circuit 65 controlling driving of a wire cleaner 80 cleaning the charge wire 88 of the electrification charger 3 is connected.

Figure 4:
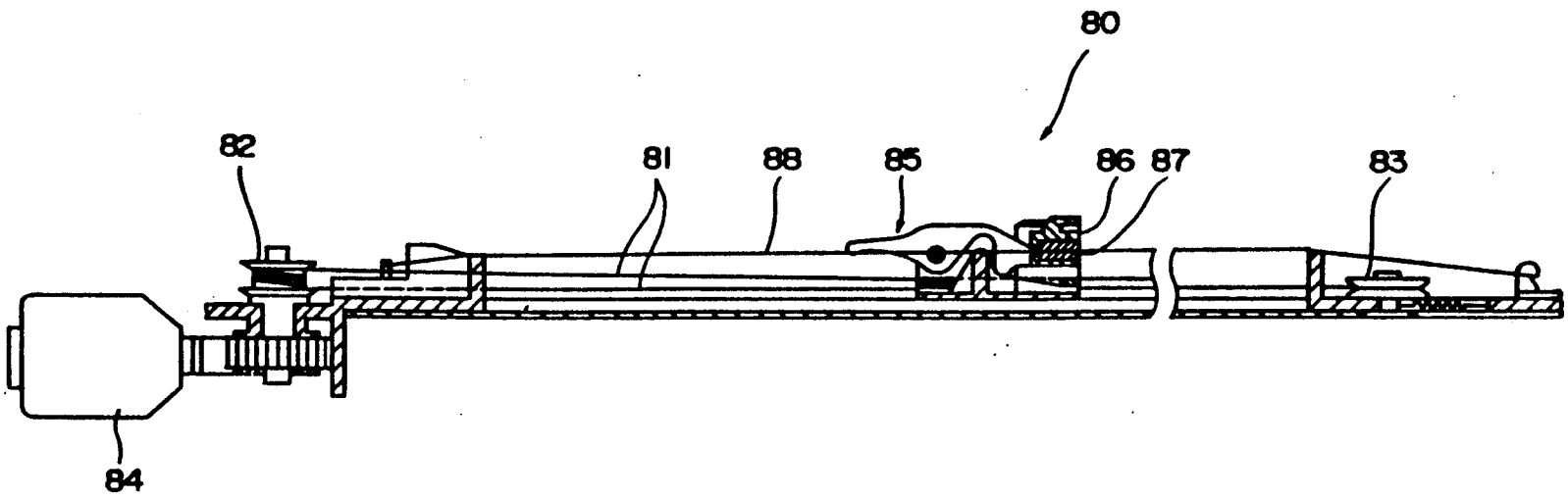
FIG. 4 is a configuration view of a wire cleaner.

FIG. 4 is a configuration view of a wire cleaner 80, and the wire cleaner 80 is constituted in a manner that a drive rope 81 is set between a drive pulley 82 and a driven pulley 83 in parallel with the direction of setting of the charge wire 88. This drive rope 81 supports a running member 85 provided with cleaning members 86 and 87 holding the charge wire 88 in a clamped state. The drive pulley 82 is rotated by a motor 84, and thereby the running member 85 cleans the charge wire 88 using the cleaning members 86 and 87 while moving in the direction of setting of the charge wire 88.

In addition, detailed description on the wire cleaner 80 is made in Ser. No. 07/399,621 applied to the U.S. Patent Office on Aug. 28, 1989, now U.S. Pat. No. 5,012,093, and therefore description thereon is omitted here.

Then, description is made on control procedures of the apparatus of the present invention configurated as described above using flow charts as shown in FIG. 5 through FIG. 8.

Figure 5:
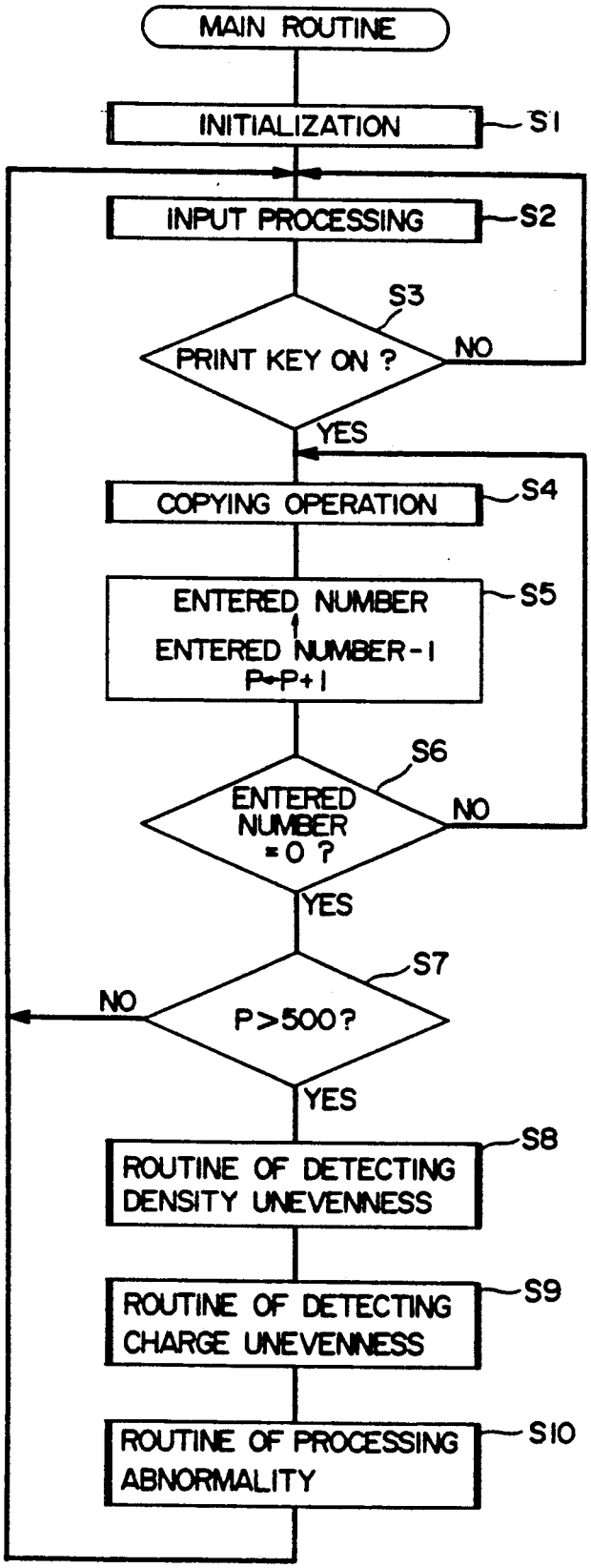
FIG. 5 is a flow chart showing processing procedures of a main routine of the control system.

In FIG. 5, initialization in Step S1 is always performed when power is turned on, and the constents of respective memories, registers and flags are set to initial values. When initialization is completed, by operating each key on the operation panel 100, input processing of copy quantity, magnification, paper size and the like is performed (Step S2). When the print key 101 is turned on (Step S3), copying operation is started (Step S4). In the next Step S5, the entered number indicating the copy quantity is decremented, and a variable P for detecting an image unevenness is incremented.

Figure 6:
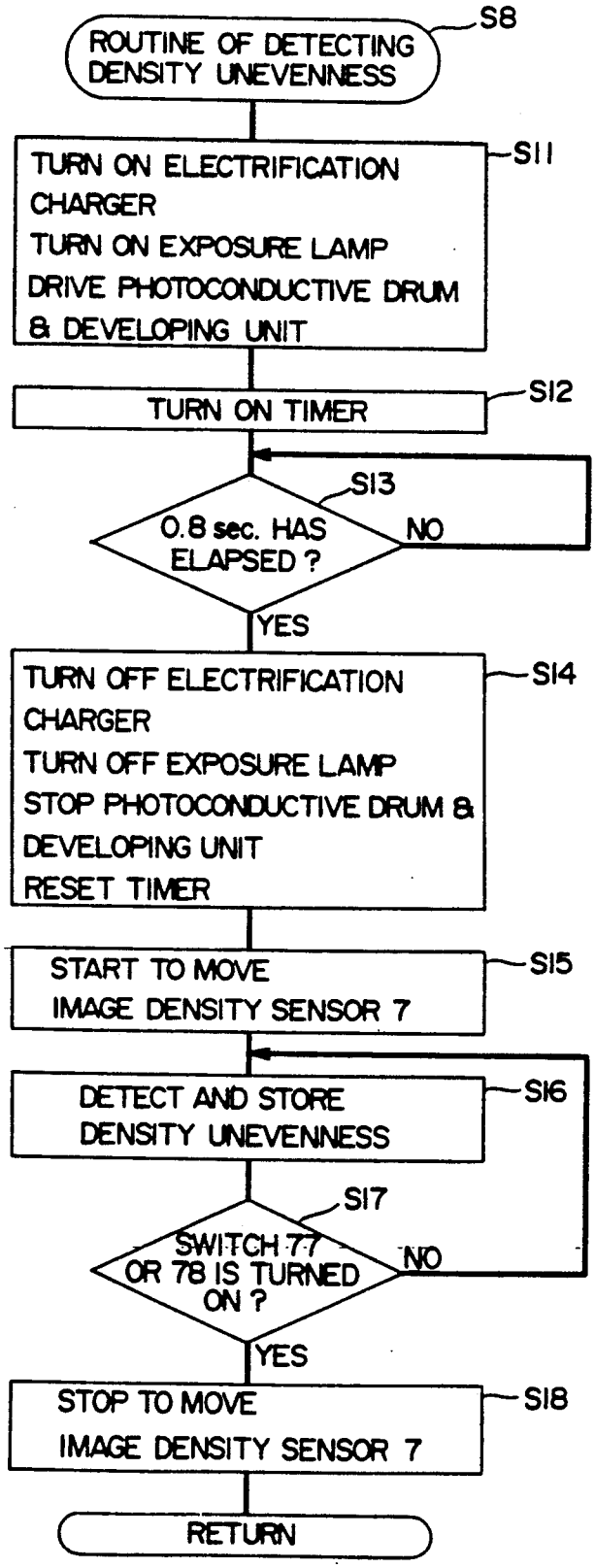
FIG. 6 is a flow chart showing procedures of detecting a density unevenness.

Then, the copying operation is continued until the entered number becomes 0 (Step S6) and when the entered number become 0, next judgment is made on whether or not variable P is larger than 500 (Step S7). When the variable P is larger than 500, processing moves to a routine of detecting density unevenness as shown in FIG. 6 (Step S8), and when it is smaller, processing is completed. Namely, in this embodiment, detection of image unevenness is performed for every 500 sheets of copy.

In the routine of detecting density unevenness of Step S8 as shown in FIG. 6, first, the electrification charger 3 and the exposure lamp 21 are turned on, and the photoconductive drum 1 and the developing unit 5 are driven (Step S11). At this time, the scanner 24 is located at the home position out of the document scanning region, and is positioned just beneath the reference pattern 12 installed on the home position side of the document glass plate 10. The quantity of light of the exposure lamp 21 is set to a predetermined level at which a halftone image is formed on the photoconductive drum 1.

Also, at this point, a timer (not illustrated) is turned on (Step S12), and at a point when the timer counts 0.8 sec, the electrification charger 3 and the exposure lamp 21 are turned off, and the photoconductive drum 1 and the developing unit 5 are stopped, and the timer is reset (Steps S13 and S14). This 0.8 sec is a time during which the region charged at the point $X_1$ on the photoconductive drum 1 as shown in FIG. 1 reaches the detection region $X_6$ of the image density sensor 7 through the exposure point $X_2$ and the developing region $X_4$ in this copying machine.

Figure 9:
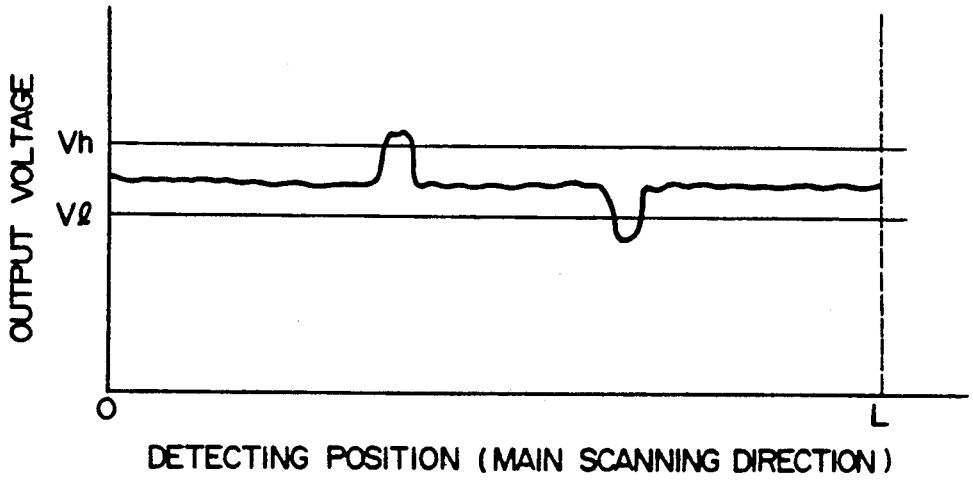
FIG. 9 is a graph showing an example of change in the detected voltage of the image density.

Resultingly, a toner image of halftone is formed in the detection region of the image density sensor 7, and the image density is detected by moving the image density sensor 7 Step S15). FIG. 9 is a graph showing an example of change in output voltage of the image density sensor 7, and the ordinate represents the output voltage of the sensor, and the abscissa represents the position of detection of the sensor in the lengthwise direction (main scanning direction) of the photoconductive drum 1, and L designates the length of the range usable for image forming of the photoconductive drum 1. If a halftone image is uniform, the output voltage is constant, but as shown in FIG. 9, if the image has a high density portion in part, the voltage becomes lower than the reference voltage VL, and if it has a low density portion in part, the voltage becomes higher than the reference voltage VH. This means that if the output voltage falls within a range of VH-VL of reference voltage, no output is made from the comparators 61 and 62, and store is performed as absence of density unevenness. Also, if the voltage falls out of that range, output is made from the comparators 61 and 62, and therefore this output is stored as presence of density unevenness (Step S16).

Subsequently, when the image density sensor 7 moves to the end part of the photoconductive drum 1 and turns on the switch 77 or 78, the movement of the image density sensor 7 is stopped (Steps S17 and S18), and thereafter detection of charge unevenness is performed.

Figure 7:
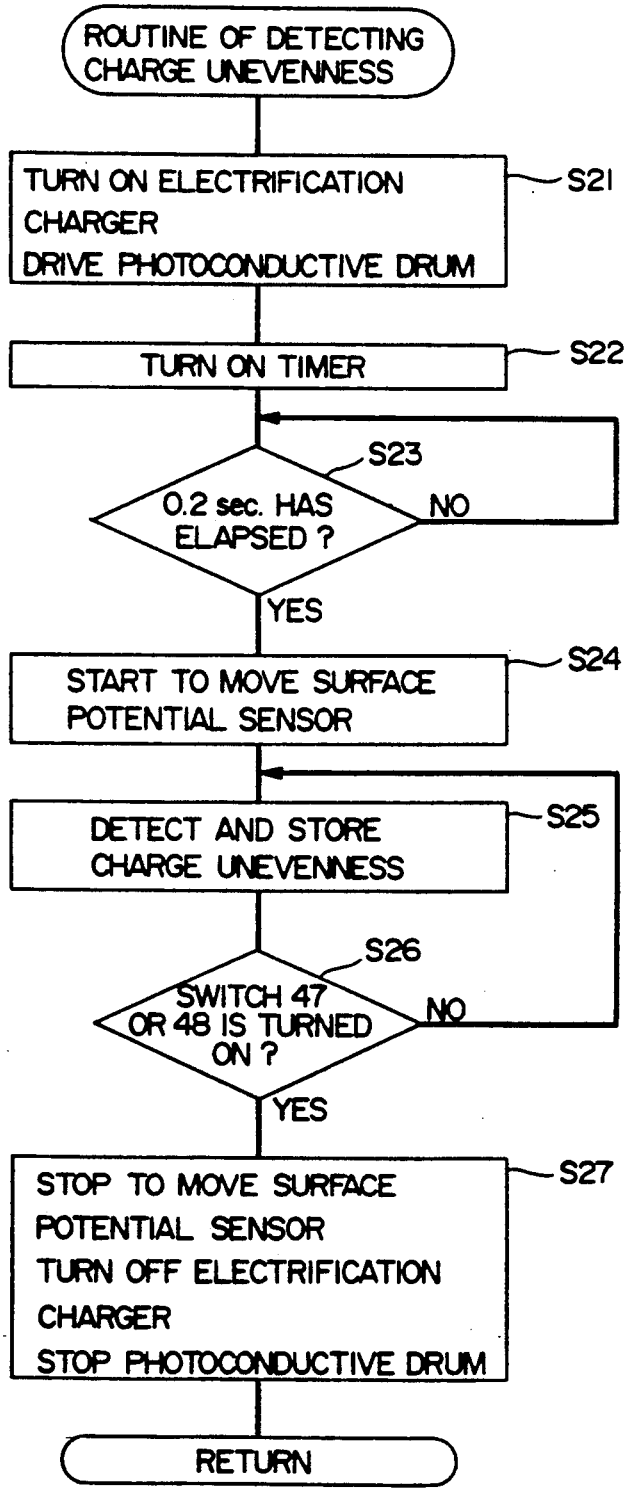
FIG. 7 is a flow chart showing procedures of dectecting a charge unevenness.

In a routine of detecting charge unevenness in Step S9 as shown in FIG. 7, first, the electrification charger 3 is turned on to drive the photoconductive drum 1 (Step S21). At this time, the exposure lamp 21 is not lit. The timer is turned on at this point (Step S22), and processing waits for 0.2 sec (Step S23). This 0.2 sec is a time during which the charged region reaches the point of measurement of the surface potential sensor 4.

Subsequently, the surface potential of the photoconductive drum 1 is detected by moving the surface potential sensor 4 (Step S24).

Figure 10:
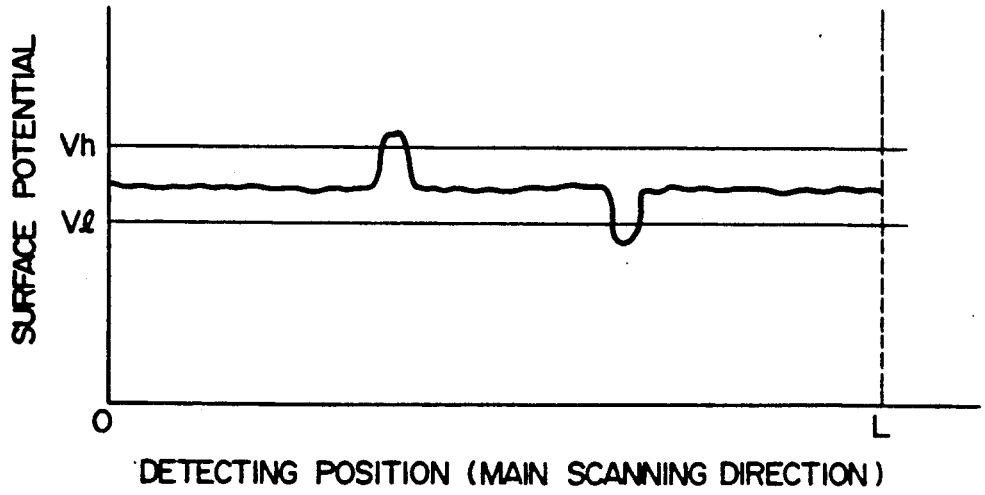
FIG. 10 is a graph showing an example of change in the detected voltage of the surface potential.

FIG. 10 shows an example of change in the output voltage of the surface potential. Like the case of FIG. 9, the abscissa represents the position of detection of the sensor in the lengthwise direction (main scanning direction ) of the photoconductive drum 1, and the ordinate represents the surface potential. Like the above-mentioned density unevenness, if the output voltage falls within a range of Vh-Vl of reference potential, no output is made from the comparators 63 and 64, store is made as absence of charge unevenness, and if it falls out of that range, outputs are made from the comparators 63 and 64, and therefore store is made as presence of charge unevenness (Step S25).

Then, the surface potential sensor 4 moves to the end part of the photoconductive drum 1, and turns on the switch 47 or 48, and then the movement of the surface potential sensor 4 is stopped, and the electrification charger 3 is turned off, and driving of the photoconductive drum 1 is stopped (Steps S26 and S27), and thereafter processing moves to a processing routine in Step S10.

Figure 8:
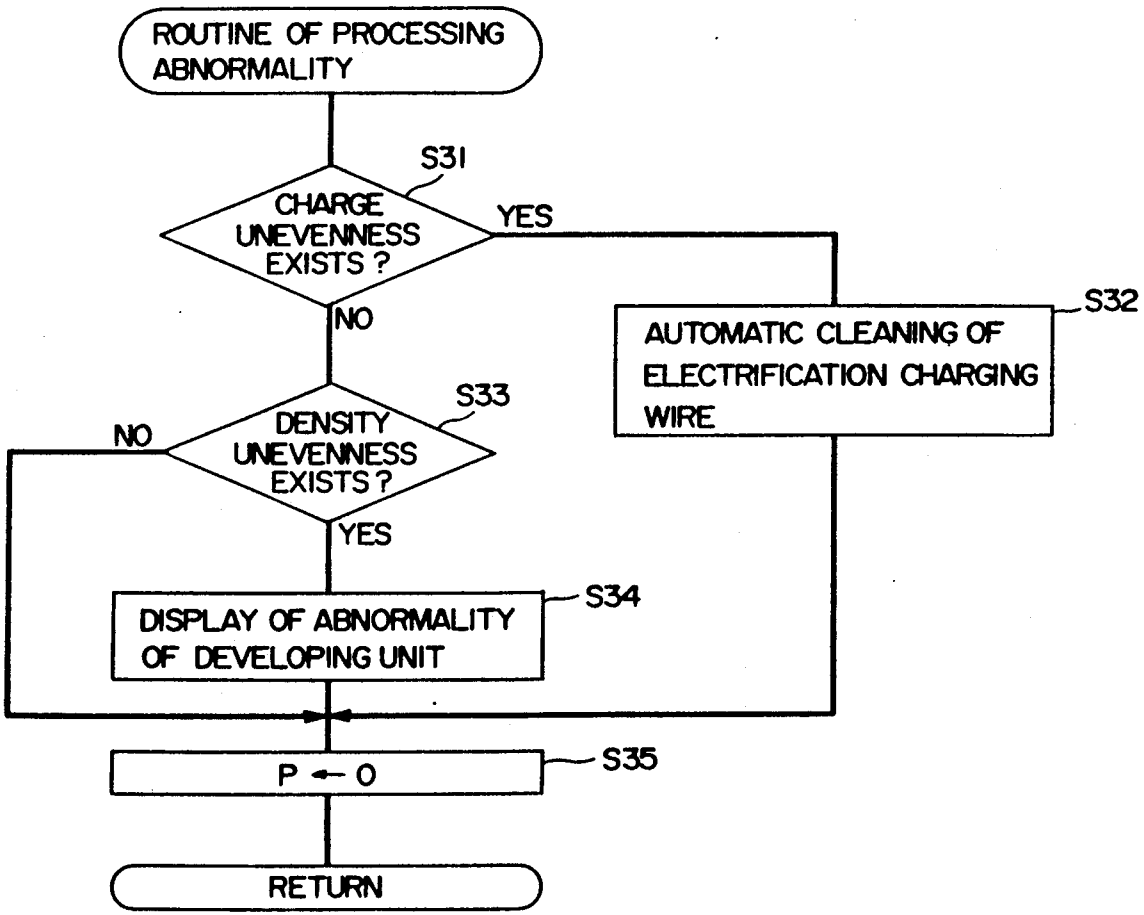
FIG. 8 is a flow chart showing procedures of processing an abnormal state.

In the routine of processing abnormality of Step S10 as shown in FIG. 8, first, in Step S31, if it is judged that charge unevenness exists, this means that the electrification charger 3 is contaminated, and therefore automatic cleaning of the charge wire 88 is performed by the wire cleaner 80 (Step S32).

On the other hand, when the result of judgment is absence of charge unevenness, subsequently presence/absence of density unevenness is judged (Step S33), and when density unevenness exists, that the developing unit 5 is abnormal is displayed by "C2" on the abnormality displaying part 111 of the operation panel 100, and the serviceman call displaying part 112 is lit (Step S34).

Thereafter, when density unevenness is absent, or when automatic cleaning of the electrification charger 3 is performed, the variable P is reset in Step S35, and processing is completed.

This means that in the apparatus of the present invention, first, a defective image is detected by the image density sensor 7, but at this point it cannot be judged that it is caused by defective charge by the electrification charger 3, or by abnormality of the developing unit 5 or another portion such as the optical system 2. Then, subsequently, the surface potential is detected by the surface potential sensor 4, and thereby, when this is normal, for example, judgment can be made that the developing unit 5 is abnormal, and when this is abnormal, it is found that defective charge has taken place, and cleaning of the charge wiree 88 is performed.

In addition, in this embodiment, charge unevenness is detected irrespective of presence/absence of detection of density unevenness, but the present invention is not limited thereto, and it is also possible that detection of charge unevenness is performed only when density unevenness is detected at the point when detection of density unevenness is performed. Also, when charge unevenness is generated, density unevenness is not required to be detected, and therefore it is also possible that density unevenness is detected only when charge unevenness is absent. By doing in such a manner, the detection time when density unevenness or charge unevenness is absent can be reduced.

Also, detection of charge unevenness and detection of density unevenness may be performed simultaneously, and thereby the detection time can be further reduced.

Furthermore, in this embodiment, when the developing unit 5 is abnormal, this abnormality is displayed, but alternatively, image forming may be inhibited.

Next, description is made on another embodiment of the present invention.

In the above-described embodiment, a defect of the electrification charger 3 or the developing unit 5 is considered as a cause of image unevenness, but in addition thereto, a defect of the transfer charger 6 is considered as a cause of image unevenness. This means that when the transfer charger 6 is contaminated, the transferring efficiency of that portion is reduced, and the image sometimes becomes low density. Accordingly, in this embodiment, density unevenness of paper after transfer is detected, and defects of the electrification charger 3, developing unit 5 and transfer charger 6 are indentified from the result of this detection in addition to the two results of detection as described above.

Figure 11:
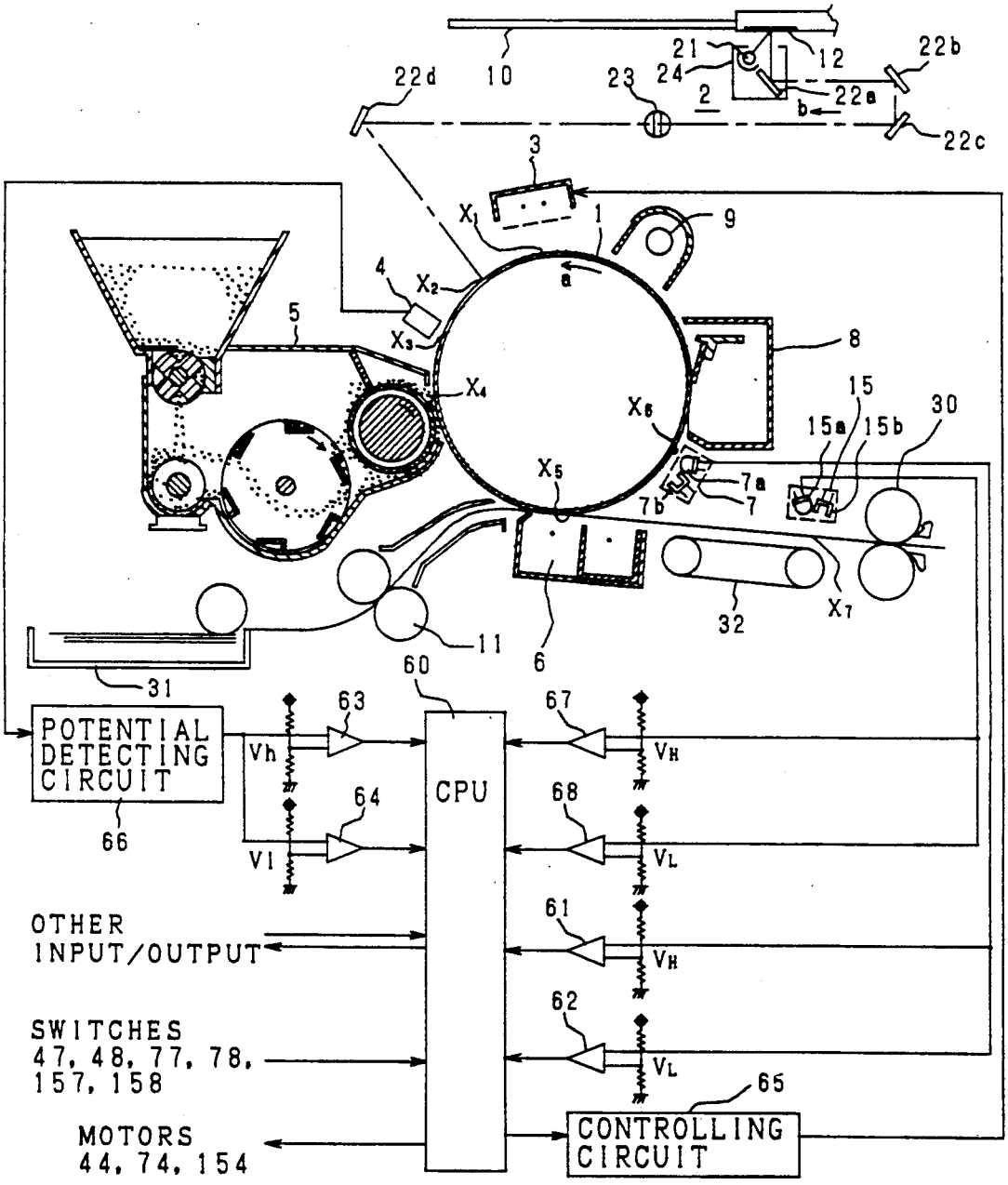
FIG. 11 is a cross-sectional view showing a schematic configuration of a copying machine of another embodiment and a block diagram of the control system.

In addition, in describing the structure and operation of this embodiment, description on portions common with the above-described embodiment are omitted. In FIG. 11, an image density sensor 15 detecting the image density of copy paper after transfer is installed above the carrying conveyer 32. This image density sensor 15 has a structure similar to the structure of the image density sensor 7 detecting the image density of the photoconductive drum 1, and a reflection-type photo-sensor having a light emitting part 15*a* and a photo-detector part 15*b* is employed.

Also, similarly, by a mechanism as shown in FIG. 3 this can be moved by a motor 154 in the direction orthogonal to the direction of carrying copy paper. Then, switches 157 and 158 are installed at the both ends of the detection region thereof.

The voltage detected by the image density sensor 15 is given to comparators 67 and 68. When the detected voltage exceeds or is less than the reference voltages VH ands VL which are determined respectively for the upper limit value and the lower limit value of a suitable image density in the toner image of halftone as described later, a signal is outputted to the CPU 60.

To the input terminal of the CPU 60, the above-mentioned switches 47, 48, 77, 78 157 and 158 and other inputs are connected, and to the output terminal thereof, the above-mentioned motors 44, 74 and 154 are connected through a driving circuit (not illustrated) and other outputs are connected.

Also, to the output terminal of the CPU 60, the controlling circuit 65 controlling driving of the wire cleaner 80 cleaning the charge wire 88 of the electrification charger 3 is connected.

Figure 12:
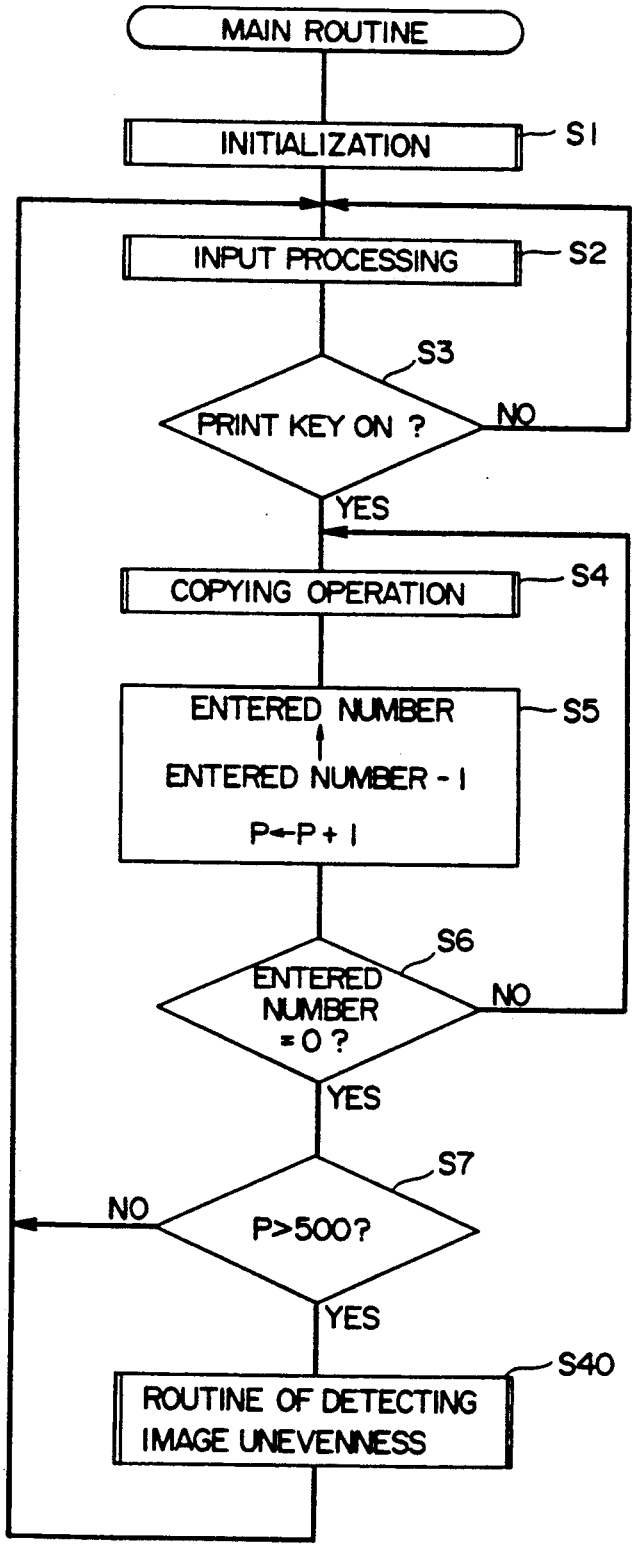
FIG. 12 is a flow chart showing procedures of processing a main routine of the same embodiment.
Figure 13:
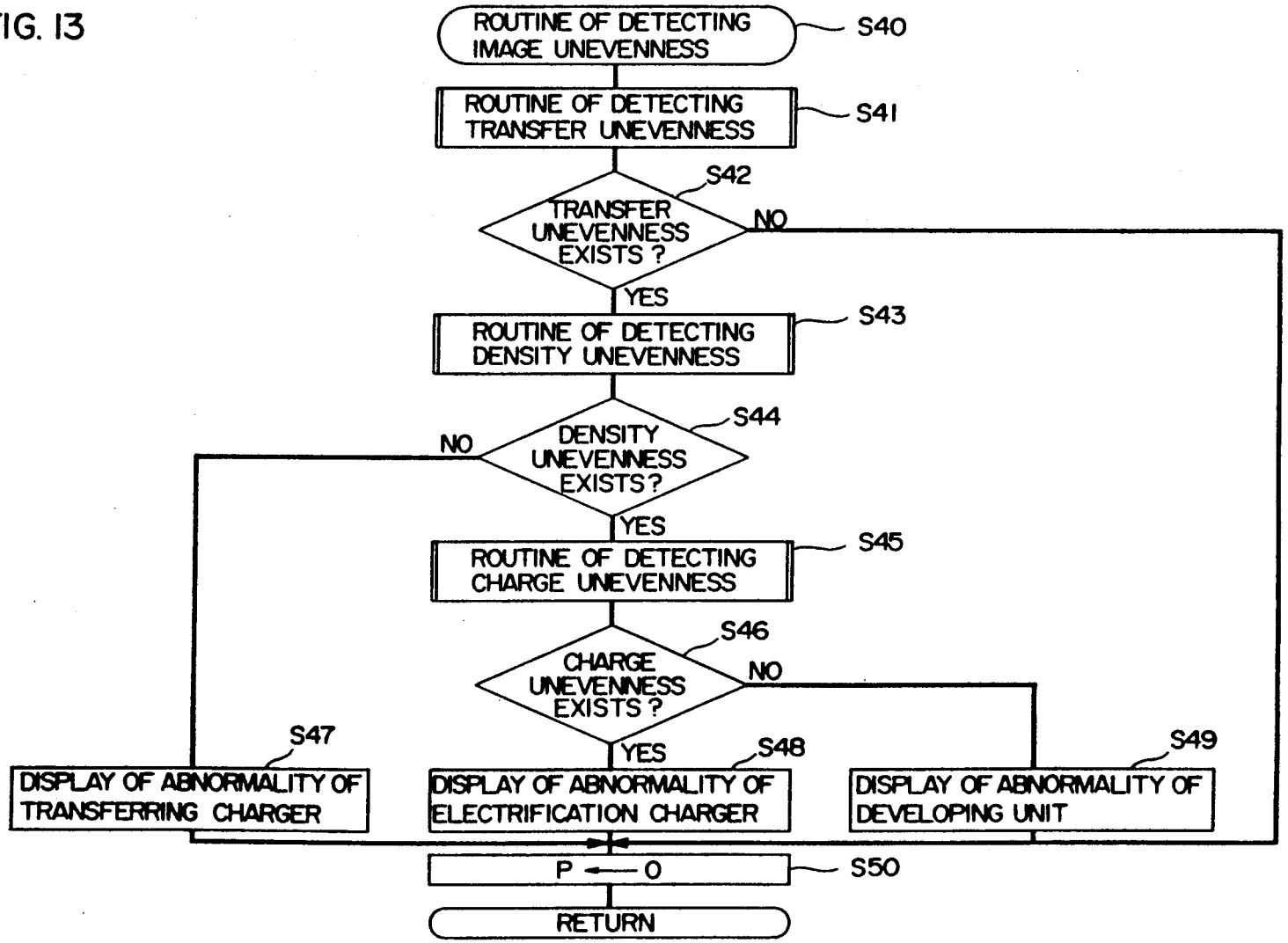
FIG. 13 is a flow chart showing procedures of detecting an image unevenness.

Next, description is made on controlling procedures of the same embodiment configurated as described above using flow charts as shown in FIG. 12 through FIG. 14. In FIG. 12, operations of Step S1- Step S7 are similar to those of the above-described embodiment, and image unevenness is detected for every 500 sheets of paper. This means that when it is judged that 500 sheets has been exceeded in Step S7, processing proceeds to a routine of detecting image unevenness in Step S40 as shown in FIG. 13.

Figure 14:
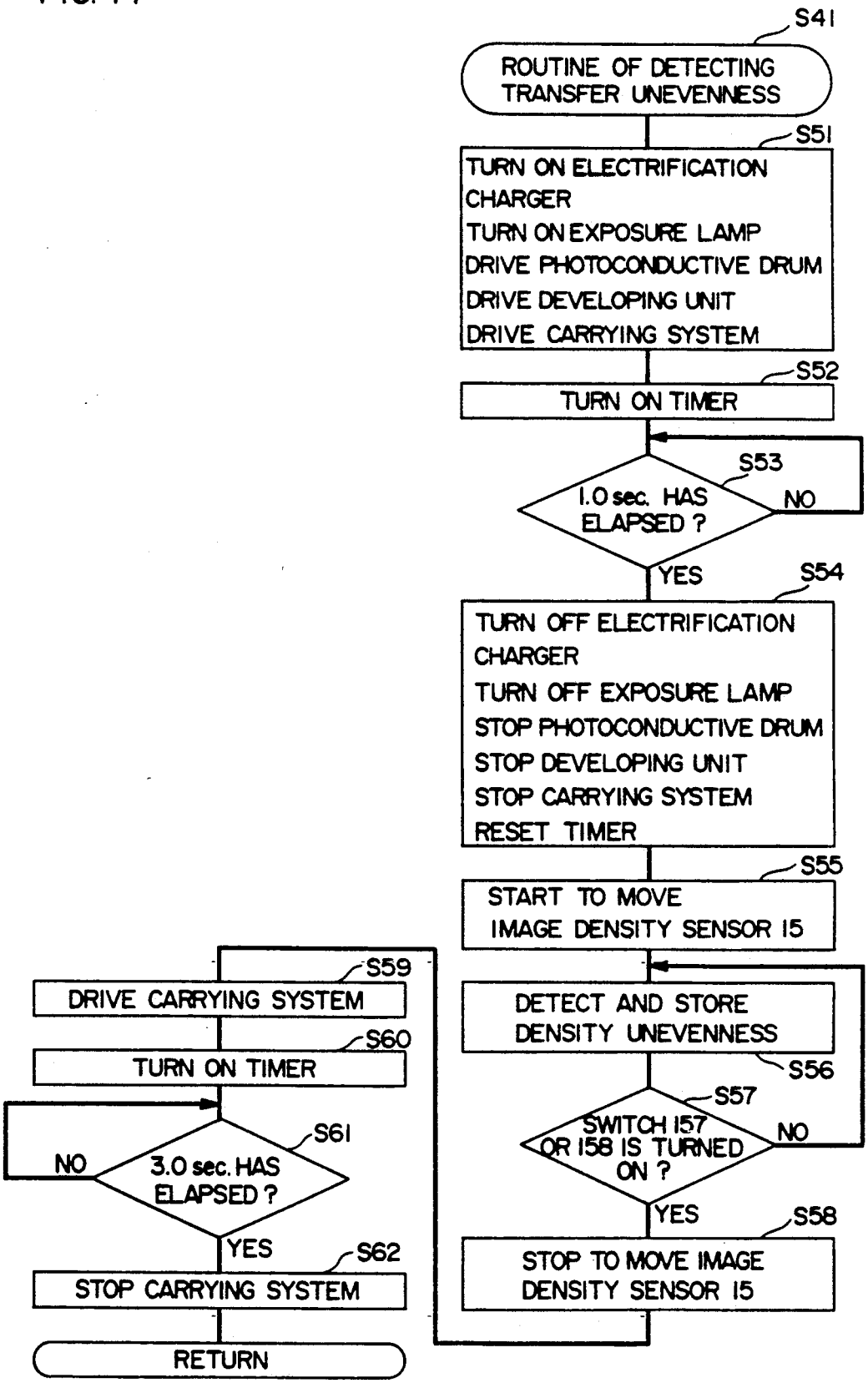
FIG. 14 is a flow chart showing procedures of detecting a transfer unevenness.

In this routine, first, processing proceeds to a routine of detecting transfer unevenness as shown in FIG. 14 (Step S41), and here presence/absence of transfer unevenness is judged (Step S42), and when transfer unevenness, that is, image unevenness is absent, processing proceeds to Step S50, resets the variable P to 0, and returns to the main routine. When transfer unevenness exists, processing proceeds to a routine of detecting density unevenness by the image sensor 7 (Step S43). This routine is similar to the one as shown in FIG. 6.

Sugsequently, presence/absence of density unevenness is judged (Step S44), and when density unevenness is absent, it is judged that the cause of the image unevenness is an abnormal state of the transfer charger 6, and "C3" is displayed on the abnormality displaying part 111, and the serviceman call displaying part 112 is lit, and copying operation is inhibited (Step S47). When it is judged that density unevenness exists in Step S44, processing proceeds to a routine of detecting charge uneveness (Step S45). This routine is similar to the one as shown in FIG. 7. Subsequently, presence/absence of charge unevenness is judged (Step S46), and when charge unevenness exists, it is judged that the cause of the image unevenness is an abnormal state of the electrification charger 3, and "C1" is displayed on the abnormality displaying part 111, and automatic cleaning of the charge wire 88 is performed by the wire cleaner 8 (Step S48). Also, when charge unevenness is absent, it is judged that the cause of the image unevenness is an abnormal state of the developing unit 5, and "C2" is displayed on the abnormality displaying part 111, and copying operation is inhibited. Then, after display, the variable P is reset to 0, and processing returns to the main routine.

In addition, when the serviceman call displaying part 112 is lit, copying operation is inhibited until a reset switch (not illustrated) is operated.

In the routine of detecting transfer unevenness of Step S41, as shown in FIG. 14, first, the electrification charger 3 and the exposure lamp 21 are turned on to drive the photoconductive drum 1, the developing unit 5 and the carrying system (Step S51). At this time, the scanner 24 is located at the home position out of the document scanning region, and is positioned just beneath the reference pattern 12 installed on the home position side of the document glass plate 10. The quantity of light of the exposure lamp 21 is set to a predetermined level at which a halftone image is formed on the photoconductive drum 1.

Also, at this point, a timer (not illustrated) is turned on (Step S52), and the electrification charger 3 and the exposure lamp 21 are turned off when this timer counts 1.0sec, and the photoconductive drum 1, the developing unit 5 and the carrying system are stopped, and the timer is reset (Steps S53 and S54). This 1.0sec is a time during which the region charged at the point $X_1$ on the photoconductive drum 1 as shown in FIG. 1 reaches the transferring region $X_5$ through the exposure point $X_2$ and the developing region $X_4$, and the toner image is transferred onto the carried copy paper, and the copy paper reaches the detection region $X_7$ of the image density sensor 15.

Resultingly, a halftone toner image is formed in the detection area $X_7$ of the image density sensor 15, and the copy paper is carried and stopped, and the image density is detected by moving the image density sensor 15 on the toner image (Step S55). The change in the detected voltage here is similar to the one as shown in FIG. 9. This means that if the image is a uniform halftone image, the output voltage is constant, but as shown in FIG. 9, if the image has a high density portion in part, the output voltage becomes lower than the reference voltage VL, and if it has a low density portion in part, the output voltage becomes higher than the reference voltage VH. This means that if the output voltage falls within a range of Vh–VL of reference voltage, no output is made from the comparators 67 and 68, and store is performed as absence of density unevenness. Also, if the output voltage falls out of that range, output is made from the comparators 67 and 68, and therefore this output is stored as presence of density unevenness (Step S56).

Next, the image density sensor 15 moves to the end part of the paper and turns on the switch 157 or 158, and thereby the movement of the image density sensor 15 is stopped (Steps S57 and S58).

Subsequently, the carrying conveyer 32 is driven (Step S59), and the timer is turned on (Step S60), and when this timer counts 3.0 sec, the carrying system is stopped (Step S62), and the copy paper is discharged outside the copying machine. This 3.0 sec is a time necessary for the copy paper to pass through the fixing unit 30 and be discharged after detection. Thereafter, processing returns to the routine of detecting image unevenness. Accordingly, the difference between this routine of detecting transfer unevenness and the above-described routine of detecting density unevenness is such that, in this routine, copy paper is fed, and an image (halftone image ) is transferred onto the copy paper, and thereafter the paper is stopped once, and is discharged after detection, and therefore the carrying system is driven again for a predetermined time.

As described above, this embodiment adopts processing procedures that the object to be checked is changed in sequence from the final stage to the initial stage of the image forming processes in such a manner that a test image (halftone image) on the copy paper being the final image is checked and if density unevenness exists, the image on the photoconductive drum 1 is checked, and then the charge in the stage before forming the image is checked, and therefore when no abnormality exists, the routine of detecting image unevenness can be completed immediately, and the time required for checking abnormality can be suppressed at a minimum.

In addition, in the above-mentioned two embodiments, the surface potential of the photoconductive drum 1, the image density and the image density of copy paper are compared with reference levels, and thereby the respective abnormal states are judged. However, it is also possible that, for example, the maximum value and the minimum value of the measured values are compared with each other, and if the difference between them exceeds a predetermined level, it is judged that charge unevenness or density unevenness exists. By doing in such a manner, only unevenness of the surface potential and the image density can be detected despite a reduction in the whole level and the like.

Also, in the above-mentioned two embodiments, detection is performed by moving the image density sensor 7 and the surface potential sensor 4 along the photoconductive drum 1, but by disposing each sensor in an array shape across the detection range, the mechanical driving means can be dispensed with; and the detection can be performed in a short time.

Furthermore, in the above-mentioned two embodiments, density unevenness is detected by forming the halftone toner image on the photoconductive drum 1 and/or the copy paper, but it is also possible that the toner image for measurement is formed without performing exposure at all.

As described above, the image forming apparatus in accordance with the present invention is configurated in a manner that the surface potential of the photoconductive drum 1 after charge is detected by the sensor, and toner images by a predetermined quantity of exposure if formed by development of the photoconductive drum 1 and/or copy paper, and density unevenness of these images is detected by the respective image density sensors, and resultingly when no charge unevenness is detected by the surface potential sensor, and only density unevenness on the photoconductive drum 1 or density unevenness on copy paper is detected, it is judged that the unevenness is not caused by contamination of the electrification charger or the like, but is caused by an abnormal state of the developing unit or the electrification charger, and therefore the unit can quickly accommodate for repair or the like, and damage can be suppressed at a minimum. Also, in the case of contamination of the electrification charger, the image unevenness can be dissolved immediately by cleaning the charge wire.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An image forming apparatus comprising:

a photoconductive member;

charging means for charging said photoconductive member;

latent image forming means for forming an electrostatic latent image on the photoconductive member charged by said charging means;

developing means for developing the formed electrostatic latent image to form a toner image;

first judging means for judging whether or not charge unevenness exists on said photoconductive member in a direction crossing the moving direction of said photoconductive member;

second judging means for judging whether or not density unevenness exists on the toner image in said direction;

abnormality detecting means for detecting presence of abnormality of said charging means and said developing means based on the results of judgments of said first and second judging means; and processing means for performing predetermined processing based on said detected results.

2. An image forming apparatus as set forth in claim 1, wherein said first judging means has charged potential detecting means for detecting the charged potential of the photoconductive member at a plurality of positions in said direction, and comparing means for comparing the charged potential detected by said charged potential detecting means with a predetermined value.

3. An image forming apparatus as set forth in claim 2, wherein said charged potential detecting means has a potential sensor installed movably in said direction, and driving means for moving said potential sensor.

4. An image forming apparatus as set forth in claim 1, wherein said second judging means has toner density detecting means for detecting the toner density at a plurality of positions in said direction, and comparing means for comparing the toner density detected by said toner density detecting means with a predetermined value.

5. An image forming apparatus as set forth in claim 4, wherein said toner density detecting means has a density sensor installed movably in said direction, and driving means for moving said density sensor.

6. An image forming apparatus as set forth in claim 4, wherein said toner density detecting means detects the toner density at a plurality of positions in said direction of the toner image formed on said photoconductive member.

7. An image forming apparatus as set forth in claim 1, wherein said second judging means judges whether or not density unevenness exists on the toner image formed on said photoconductive member in said direction.

8. An image forming apparatus as set forth in claim 7, further comprising transferring means for transferring the toner image formed on said photoconductive member onto a transfer member, and third judging means for judging whether or not density unevenness exists on the toner image on the transfer member in the direction crossing the moving direction of said transfer member, said abnormality detecting means detecting presence of abnormality of said charging means, developing means and transferring means based on the results of judgments of said first, second and third judging means.

9. An image forming apparatus as set forth in claim 8, wherein said transfer member is paper.

10. An image forming apparatus as set forth in claim 8, wherein said processing means displays abnormality of said charging means, developing means and/or transferring means based on the detected results of said abnormality detecting means.

11. An image forming apparatus as set forth in claim 8, wherein said processing means inhibits image forming operation when said abnormality detecting means detects abnormality of said transferring means.

12. An image forming apparatus as set forth in claim 8, wherein said abnormality detecting means detects abnormality of said transferring means when the second judging means judges that no density unevenness exists, and the third judging means judges that density unevenness exists.

13. An image forming appratus as set forth in claim 1, wherein said abnormality detecting means detects abnormality of said charging means when the first judging means judges that charge unevenness exists.

14. An image forming apparatus as set forth in claim 1, wherein said abnormality detecting means detects abnormality of said developing means when the first judging means judges that no charge unevenness exists, and the second judging means judges that density unevenness exists.

15. An image forming apparatus as set forth in claim 1, wherein said processing means displays abnormality of said charging means and said developing means based on said detected results of said abnormality detecting means.

16. An image forming apparatus as set forth in claim 1, wherein said processing means inhibits image forming operation when said abnormality detecting means detects abnormality of said developing means.

17. An image forming apparatus as set forth in claim 1, wherein said processing means comprises abnormality restoring means for restoring said charging means from an abnormal state to normal state, and restores said charging means to normal state by said abnormality restoring means when said abnormality detecting means detects abnormality of said charging means.

18. An image forming apparatus comprising:

a photoconductive member;

charging means for charging said photoconductive member;

latent image forming means for forming an electrostatic latent image on the photoconductive member charged by said charging means;

developing means for developing said electrostatic latent image into a toner image;

transferring means for transferring the toner image formed on said photoconductive member onto a transfer member;

first detecting means for detecting charge unevenness on said photoconductive member in a first direction crossing the moving direction of said photoconductive member;

second detecting means for detecting density unevenness on the toner image on the transfer member in a second direction crossing the moving direction of said transfer member;

first abnormality judging means for judging presence of abnormality of said charging means when said first detecting means detects the charge unevenness; and second abnormality judging means for judging presence of abnormality of said transferring means when said first detecting means does not detect the charge unevenness and said second detecting means detects the density unevenness.

19. An image forming apparatus as set forth in claim 18 further comprising:

third detecting means for detecting density unevenness on the toner image on the photoconductive member in said first direction;

third abnormality judging means for judging presence of abnormality of said developing means when said first detecting means does not detect the charge unevenness and said third detecting means detects the density unevenness.

20. An image forming apparatus comprising:

an electrostatic latent image holding member;

latent image forming means for forming an electrostatic latent image on said electrostatic latent image holding member;

developing means for developing said electrostatic latent image into a toner image;

transferring means for transferring the toner image formed on said photoconductive member onto a transfer member;

first detecting means for detecting density unevenness on the toner image on the photoconductive member in a first direction crossing the moving direction of said electrostatic latent image holding member;

second detecting means for detecting density unevenness on the toner image on the transfer member in a second direction crossing the moving direction of said transfer member;

first abnormality judging means for judging presence of abnormality of said developing menas when said first detecting means detects the density unevenness and second abnormality judging means for judging presence of abnormality of said transferring means when said first detecting means does not detect the density unevenness and said second detecting means detects the density unevenness.

21. An image forming apparatus comprising;

a photoconductive member;

charging means for charging said photoconductive member;

latent image forming means for forming an electrostatic latent image on the photoconductive member charged by said charging means;

developing means for developing said electrostatic latent image into a toner image;

transferring means for transferring the toner image formed on said photoconductive member onto a transfer member;

first detecting means for detecting charge unevenness on said photoconductive member;

second detecting means for detecting density unevenness on the toner image developed by said developing means; and abnormality judging means for judging presence of abnormality of said developing means when said first detecting means does not detect the charge unevenness and said second detecting means detects the density unevenness.

22. A method of forming an image comprising steps of:

charging a photoconductive member by charging means;

detecting charge unevenness in a first direction crossing the moving direction of said photoconductive member;

forming an electrostatic latent image on the charged photoconductive member;

making toner adhere to the formed electrostatic latent image by developing means to obtain a toner image;

detecting toner adhesion unevenness in said first direction; and judging that said dveloping means is abnormal when no charge unevenness is detected, and said adhesion unevenness is detected.

23. A method of forming an image as set forth in claim 22, further comprising steps of:

transferring said toner image onto a transfer member by transferring means;

detecting density unevenness of the other image on said transfer member in a second direction crossing the moving direction of said transfer member; and judging that said transferring means is abnormal when said toner adhesion unevenness is not detected, and said density unevenness is detected.

* * * * *